US005175983A

United States Patent [19]

Artzt et al.

[11] Patent Number: 5,175,983

[45] Date of Patent: Jan. 5, 1993

[54] YARN SPLICING DEVICE FOR THE KNOT-FREE PIECING OF YARNS AND PROCESS FOR THE PREPARATION OF YARN ENDS

[75] Inventors: Peter Artzt, Reutlingen; Heinrich Preininger, Filderstadt; Gerhard Egbers, Reutlingen, all of Fed. Rep. of Germany

[73] Assignee: Schubert & Salzer Maschinenfabrik AG, Ingolstadt, Fed. Rep. of Germany

[21] Appl. No.: 808,957

[22] Filed: Dec. 13, 1991

Related U.S. Application Data

[63] Continuation of Ser. No. 635,808, Jan. 2, 1991, abandoned, which is a continuation of Ser. No. 395,807, Aug. 18, 1989, abandoned.

[30] Foreign Application Priority Data

Aug. 28, 1988 [DE] Fed. Rep. of Germany ..... 3828319

[51] Int. Cl.[5] ..... D01H 15/00

[52] U.S. Cl. ..... 57/1 UN; 57/22; 57/350

[58] Field of Search ..... 57/1 UN, 22, 261, 263, 57/350

[56] References Cited

U.S. PATENT DOCUMENTS

| | | | |
|---|---|---|---|
| 4,263,775 | 4/1981 | Mima | 57/22 |
| 4,439,978 | 4/1984 | Mima | 57/22 |
| 4,494,366 | 1/1985 | Deno | 57/22 |
| 4,549,392 | 10/1985 | Kimura | 57/22 |
| 4,566,260 | 1/1986 | Irmen | 57/22 |
| 4,653,260 | 3/1987 | Artzt et al. | 57/263 |
| 4,757,678 | 7/1988 | Stahlecker | 57/263 |
| 4,796,418 | 1/1989 | Rebsamen et al. | 57/22 |

FOREIGN PATENT DOCUMENTS

| | | | |
|---|---|---|---|
| 3151270 | 7/1983 | Fed. Rep. of Germany . | |
| 3417367 | 11/1984 | Fed. Rep. of Germany . | |
| 3518316 | 11/1986 | Fed. Rep. of Germany | 57/22 |
| 4710603 | 3/1972 | Japan . | |

*Primary Examiner*—Joseph J. Hail, III
*Attorney, Agent, or Firm*—Dority & Manning

[57] ABSTRACT

A yarn splicing device for piecing spun yarns without knots. It contains a yarn splicing chamber and a small pipe through which fluid flows, at a distance from the yarn splicing chamber. The small pipe serves to receive a yarn end and to prepare it for the splicing process. The small pipe has a roughened inner surface which makes contact with the yarn end in a battering manner. In the process for the yarn end preparation, the small pipe is traversed turbulently by a fluid. The yarn end is battered by the turbulent flow against the roughened inner surface of the small pipe until the yarn end is free of twist.

16 Claims, 3 Drawing Sheets

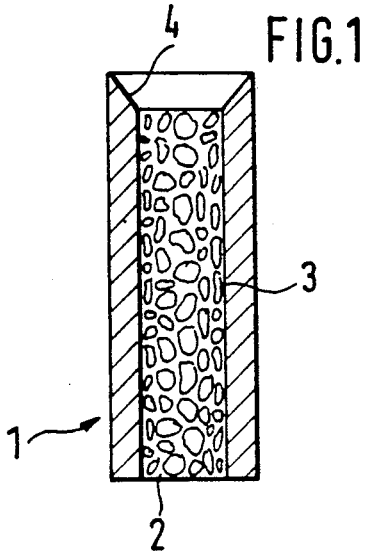
FIG.1
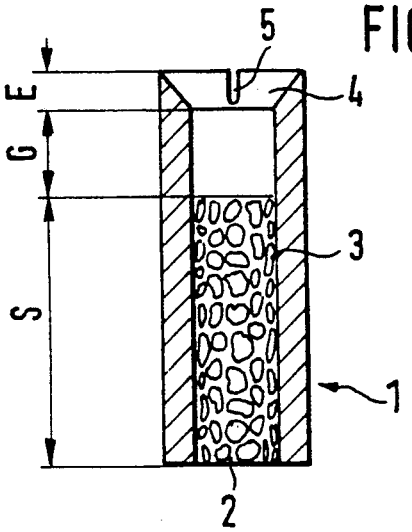
FIG.2
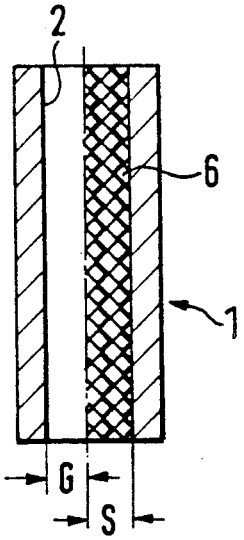
FIG.3
FIG.4
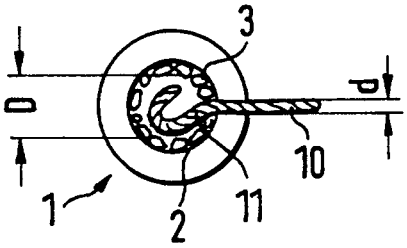
FIG.5
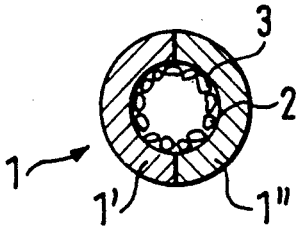

YARN SPLICING DEVICE FOR THE KNOT-FREE PIECING OF YARNS AND PROCESS FOR THE PREPARATION OF YARN ENDS

This is a continuation of application Ser. No. 07/635,808, filed Jan. 2, 1991, which is a continuation of Ser. No. 395,807 filed Aug. 18, 1989both of which are abandoned.

BACKGROUND OF THE INVENTION

The instant invention relates to a yarn splicing device for the knot-free piecing of yarns. The device includes a yarn splicing chamber and a small pipe through which fluid flows which is installed at a distance from the yarn splicing chamber to receive a yarn end to be prepared for the splicing process. The invention also includes a process for the yarn end preparation in such a yarn splicing device.

In order to achieve good quality in the piecing joint, the piecing of yarn ends by splicing requires that the preparation of the yarn ends be carried out with care. The yarn end must be free of twist over a certain length so that it can be pieced properly in the spinning device to a second yarn end which is also essentially free of twist.

It is known that the yarn ends are prepared in devices in which said yarn ends are subjected to a stream of fluid which seizes the yarn at a right angle to the longitudinal axes of the yarns by means of pressure or suction force thus produced and which swirls them so that the yarn ends are untwisted. The preparation of only one yarn end in the known device shall be described below.

In the known device, the stream of fluid enters a small pipe into which it pulls or pushes the yarn end at an angle to the longitudinal axis and the yarn end is untwisted by the turbulent flow thus produced against its twist. The fibers constituting the yarn end are freed by this flow and are spread out. Conventional ring spun yarns can be spliced successfully in this manner.

It is more difficult to splice multiple yarns or threads consisting of two or more individual strands twisted around each other, where the twist of the individual strands goes in the opposite direction to the twist of the yarn constituted by the individual strands twisted around each other. German Patent No. 3,417,367 deals with such an improvement. According to this known design, a stream of fluid is brought into each nozzle pipe at an angle to the longitudinal axis of the nozzle pipe, with the stream of fluid striking an impact plate installed within the nozzle pipe. When the stream of fluid strikes the impact plate, turbulent flows are produced in which the yarn end portion executes non-swirling movements, i.e., pitching movements and oscillations which causes the twist of the individual strands to be undone.

Another known device (German Patent No. DE 3,151,270 A1) proposes a more intensive mechanical and pneumatic stressing of the yarn ends for the same purpose, that is, to open the yarn ends into individual fibers, to clean the fibers and to spread them out. This is effected in that the gas under pressure, streaming at an angle to the longitudinal direction of the individual fibers, causes the yarn ends to oscillate while at the same time battering, tearing and pulling mechanical and pneumatic forces act upon the yarn end. This process is relatively expensive. It, furthermore, involves the danger that such intensive, violent opening of the yarn ends causes the individual fibers to be damaged so that they are no longer suitable for a good splicing joint.

The yarns produced by new spinning methods pose a special problem for splicing. This applies, in particular, to yarns produced by the open-end rotor spinning process, in the fiber wind-around spinning process or in similar new spinning processes. This type of yarn manufacture does not produce uniform twist in the yarn. Furthermore, these yarns often have individual fibers wound around the yarn (so-called belly bands) which are very difficult to undo. The splicing methods used until now have proven to be of little use for this, and this is the reason why the splicing of such yarns still presents a problem today.

SUMMARY OF THE INVENTION

It is, therefore, the object of the instant invention to provide a process and a device which makes it possible to splice any kind of yarns in a simple manner.

This object is attained through the instant invention in that the small pipe is provided with a rough inner surface which contacts the yarn ends in a battering manner, and in that a fluid flows turbulently through the small pipe, with the yarn end being battered by the turbulent stream against the rough inner surface of the small pipe until the yarn end is free of twist.

In one embodiment the inner surface of the small pipe is roughed up by means of diagonal knurling. This is an economical surface treatment of the inner surface of the small pipe. An irregular arrangement of the edges facilitates the untwisting of the yarn because the yarn cannot mold itself so easily to the valleys of the structure. If the surface has sharp edges the untwisting of the yarn ends is further facilitated.

In order to prepare the yarn end without damaging it, the roughened inner surface of the small pipe is oriented axially and, within limits, over a portion of the circumference. Thus, a precisely determined zone of the yarn end to be untwisted is determined in advance. If the small pipe has an inside diameter which is a multiple of the yarn thickness, secure introduction of the yarn end into the small pipe as well as sufficient movement of the yarn within the pipe is ensured. If the inside diameter is equal, at the most, to one half the length of the yarn end extending into the small pipe, very good untwisting results can be obtained in the yarn end.

Rapid adjustment to different lengths of yarn ends to be untwisted can be achieved by a shifting adjustment of the small pipe in its axial direction. In one embodiment, a yarn introduction zone with a diameter that increases towards the end of the small pipe, e.g., in form of a conical widening, is provided at the end of the small pipe closest to the yarn splicing chamber. If the surface of the yarn introduction zone is also smooth, the introduction of the yarn end into the small pipe is facilitated. The introduction of the yarn end is further facilitated by means of a slit located in the yarn introduction zone in the direction of the longitudinal axis of the small pipe.

If the small pipe is designed so that it can be inserted into the yarn splicing device in either direction, it is advantageous to ensure that small pipes with different characteristics in their inner surface structure can be adapted to different yarn qualities. For this purpose, the small pipe is rotated so that the yarn insertion takes place, at will, at one end of the small pipe, and upon rotating the pipe by 180° at its other end. If a rotatable element in which at least one small pipe is installed is provided on the yarn splicing device, the small pipe can be used rapidly and easily for cleaning purposes or used at either side. If the rotatable element of the small pipe is provided with inner surfaces of different degrees of roughness, it is possible, and advantageous, to always use the best-suited small pipe for different yarn qualities. This is especially advantageous with machines in which different yarn qualities are produced. This also applies to the small pipe located in the rotatable element and provided with inner surfaces with different zones of roughness.

The process, according to the invention, consists in having a turbulent stream of fluid flowing through the small pipe in which the yarn end is battered by the turbulent flow against the structured inner surface of the small pipe so that the yarn end becomes free of twist. It is advantageous that even stubborn twists, such as occur for example in threads and rotor yarns with belly band windings, be opened relatively gently by the battering contact with the structured inner surface. By limiting the duration of the flow of fluid per yarn end preparation to a given period of time, a uniform untwisting result is achieved as a function of the yarn quality being processed at the time. Fluid consumption is also limited advantageously. A period of less than 30 msec has here proven to be advantageous for the duration of the fluid stream per yarn end preparation.

If the fluid for each yarn end preparation is caused to flow through at intervals, the battering contact between the yarn end and the structured inner surface of the small pipe is increased by acceleration forces which are constantly renewed as they act upon the yarn end.

It has been found that the stronger the yarn to be untwisted, or the stronger the twist in the yarn, the longer the flow of fluid is indicated. This causes the yarn ends to be battered against the inner surface of the small pipe for a longer period of time. It has also been found that greater roughness of the inner surface of the small pipe should be selected and is advantageous if the yarn to be untwisted is thicker and/or if the twist of the yarn is stronger. A further possibility of influencing untwisting of the yarn as a function of yarn quality consists in selecting greater fluid pressure. This also makes it possible to obtain better untwisting of the yarn end.

If the fluid is introduced at one end of the small pipe and flows through the entire length of the small pipe along its axis, an optimal utilization of the length of the small pipe become possible. The introduction of the yarn end into the small pipe is facilitated since the yarn end is blown into the small pipe and is not aspired. Furthermore, such a pressure flow through the small pipe makes it possible to simplify the design of the yarn splicing device considerably.

It has been found, surprisingly, that the yarn splicing device and the process of the invention for the preparation of the yarn ends make it possible to achieve very good splicing results, even with yarn ends which have been difficult to free from their wound-around fibers until now, and at low mechanical expenditure.

BRIEF DESCRIPTION OF THE DRAWINGS

FIGS. 1 to 3 show various longitudinal sectional views through a small pipe;

FIG. 4 shows a top view of a small pipe;

FIG. 5 shows a cross-sectional view through a divided small pipe;

DETAILED DESCRIPTION OF THE INVENTION

Figure 6:
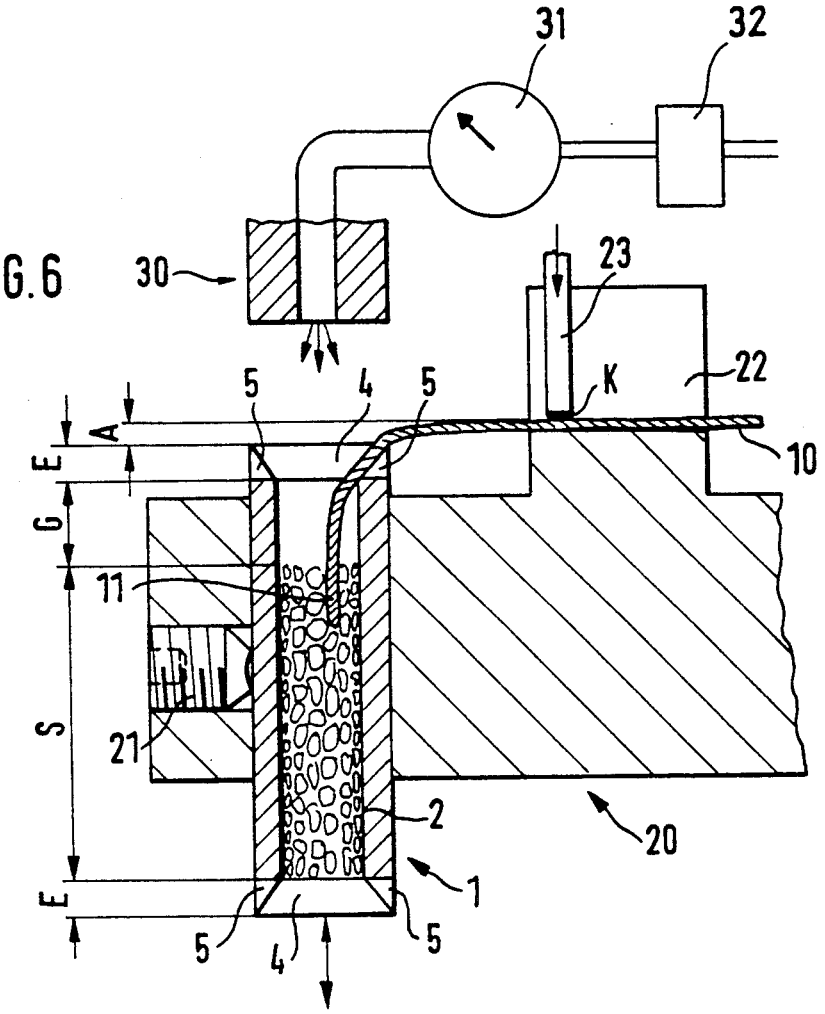
FIGS. 6 to 8 show various longitudinal sections through yarn splicing devices with an installed small pipe.

FIG. 2 shows a further embodiment of the small pipe 1 according to the invention. At the yarn insertion taper 4 and advantageous yarn insertion groove 5 is provided into which the yarn end 11 positions itself before it goes into the small pipe 1. Yarn insertion groove 5 stabilizes the yarn end 11 through its groove-shaped configuration and prevents its lateral escaping and, thereby, a faulty preparation attempt.

In the small pipe 1 of FIG. 2 a smooth zone G first follows a yarn insertion zone E on the inner surface 2 of pipe 1. A structured or textured zone S follows this smooth zone G. By using small pipe 1 the length of the yarn end 11 to be freed of its twist is limited. A reversal or untwisting of the twist occurs only as far as the border zone between smooth and structured zones G, S. With the length of the yarn end 11 being the same as with the small pipe 1 shown in FIG. 1, a shorter length of the yarn end 11 is freed of its twist with small pipe 1, as shown in FIG. 2. The utilization of different small pipes 1 makes it possible to easily change over a yarn splicing device 20 for yarns with different fiber lengths, on which the length of the yarn end 11 to be untwisted depends.

The embodiment with a small pipe 1 shown in FIG. 3 represents an inner surface 2 with a limit of the structured zone S in a portion of the inner circumference. The smooth zone G of the inner surface 2 occupies the remaining portion of the inner circumference of the small pipe 1. With yarns having fibers wound around it with average strength, such an embodiment ensures gentler untwisting of the yarn end 11 than would be the case with an overall structured rough inner surface 3, 6 of the small pipe 1.

The combination of the rough inner surface 3, 6 of the small pipes 1 with smooth surfaces as shown in FIGS. 2 and 3 is advantageous if a limited piece of the yarn end 11 is to be untwisted gently, since the yarn end 11 is not constantly exposed to the rough inner surface 3, 6. The structure 3 or 6 can be linear or helicoidal, depending on the type of yarn, if the rough inner surface 3, 6 of the small pipe 1 is disposed axially and over part of the circumference of the inner surface 2 of the small pipe 1.

Structure 6 of the small pipe 1 in FIG. 3 is different from those shown in FIGS. 1 and 2 and is not obtained through granulation but through diagonal knurling of the surface. The structuring of the surface can also be achieved by means of laser irradiation or erosion. This treatment of the inner surface 2 is often less costly to manufacture and longer lasting than to place material against the inner surface 2.

Gentle untwisting of the yarn end 11 is possible according to the pipes of FIGS. 1 to 3 in that the structure of the inner surface 2 is given more or less roughness. The rougher and thicker yarn 10, and the narrower and tighter the twist of yarn 10, the rougher, the more aggressive and the larger the surface of the structure must be on the inner surface 2 of the small pipe 1. The mechanical stress to which the yarn end 11 is subjected is limited to a minimum by the appropriate selection of the structure surface.

FIG. 4 shows a top view of the small pipe 1 in which grains 3 are provided on the inner surface 2. Here, it can be seen that the sharp edges of the grains 3 extend into the passage opening of the small pipe 1. The yarn end 11 catches part of its fibers on these sharp edges and dissolves the structure formed by the fibers while having imparted to it a pitching movement by the turbulent flow-through of the stream of fluid. The yarn end 11 is thus transformed into a fiber bundle with spread-out fibers. The length of the fiber bundle is limited by the average fiber length since the fibers of the yarn end 11 must have one end remain incorporated into the yarn in order not to be removed completely from the yarn by the stream of fluid.

A free inside diameter D is a multiple of the yarn thickness d and is equal, at the most, to one half of the length of the yarn end 11 extending into the small pipe 1. This ensures that the yarn end 11 has sufficient room for its battering movements, on the one hand and on the other hand, that the rough inner surface 3, 6 makes contact with a sufficient length of the yarn end 11.

In FIG. 5 a divided design of the small pipe 1 is shown in a section across its longitudinal axis. The pipe halves 1' and 1'' are joined together in the yarn splicing device 20 by means of adhesive, screwing or clamping. The division of the small pipe 1 allows for a very simple installation of the structure on the inner surface 2 of the small pipe 1. The arrangement of grains 3 as well as the finishing of the inner surfaces 2, according to FIG. 3, is greatly simplified thanks to good accessibility. If a soluble bond is used, cleaning or maintenance of the structure is made easier than in a small pipe 1 that is not divisible.

A longitudinal section through the yarn splicing device 20 and through the small pipe 1 as seen in FIG. 6 shows the arrangement of the small pipe 1 in the yarn splicing device 20 in one embodiment. The small pipe 1 is attached in the yarn splicing device 20 so as to be continuously adjustable in an axial direction. It is clamped in place by a screw 21 which presses against the outer wall of the small pipe 1. By loosening the screw 21 and shifting the small pipe 1 in an axial direction, a distance A can be set. The distance A designates the distance between the plane of a yarn clamping point K and the end of small pipe 1, measured in the direction of the longitudinal axis of the small pipe 1. By altering distance A it is possible to adjust the range within which the yarn end 11 is untwisted while the length of the yarn 10 between clamping point K and yarn end 11 remains constant. The yarn end 11 extends into the small pipe 1 or towards the structured zone S to a greater or lesser extent when the distance A is altered.

The example of a yarn splicing device 20, shown in FIG. 6, utilizes a small pipe 1 capable of being used by either side. This small pipe 1 has the advantage that the range within which the yarn end 11 is to be untwisted can be enlarged considerably by turning the small pipe, with the position of the yarn insertion zone E in relation to a yarn splicing chamber 22 remaining essentially the same.

In the type of assembly shown, starting at the side of the yarn insertion, the yarn insertion zone E, with the yarn insertion groove 5, is followed by a smooth zone G on the inner surface 2 of the small pipe 1. Untwisting of the yarn end 11 is not possible against zone G because it is less aggressive or rough than the structured zone S. The twist of the yarn end 11, which comes into contact with the structured zone S, is opened in the small pipe 1 as a stream of fluid is blown into it. In the embodiment shown in FIG. 6 the untwisted yarn end 11 starts only after the smooth zone G. If the small pipe 1 is turned against a nozzle 30 with the opening, which is not shown, the structure zone S follows immediately after the yarn introduction zone E so that the untwisted yarn end 11 becomes longer while the distance A remains the same.

To ensure insertion of the yarn end 11 into the small pipe 1 at any of the possible positions of the small pipe 1, a yarn insertion tape 4 (with two yarn insertion grooves 5) is provided at either end of the small pipe 1. The two insertion grooves 5 ensure that the yarn ends 11 can be laid across the opening of the small pipe 1 and find a guiding surface in insertion grooves 5. This ensures that the yarn end 11 is blown into the small pipe 1 and not to the side, next to small pipe 1. The conical surfaces of the yarn insertion tapes 4 further increase this effect. In arrangements in which the inflow of fluid occurs near the small pipe 1 it is sufficient if only one of the two yarn insertion aids, either the yarn insertion taper 4 or the yarn insertion groove 5 is provided on the small pipe 1 or on the yarn splicing device 20.

The nozzle 30 (in FIG. 6) is located as an axial extension of the small pipe 1. Fluid, preferably air, is blown through the nozzle 30 into the small pipe 1. The fluid flows through the small pipe 1 and is given a turbulent flow, in which the yarn end 11 is given a battering motion by the sharp-edged structure of the inner surface 2 of the small pipe 1. The yarn end 11 batters against the roughened structure of the inner surface 2 of the small pipe 1 and, thus, frees itself of the fibers that are wound around it. It is also possible to install the nozzle 30 at the other end of the small pipe 1, the nozzle being in form of a suction nozzle, for example, instead of a compressed air nozzle. The fluid is, nevertheless, always introduced at one end of the small pipe 1 and flows through the entire length of the small pipe 1 along its axis.

Depending on the thickness of the yarn 10 and/or on the tightness of the twist of the yarn 10, a fluid pressure of greater or lesser strength is selected. This makes it possible to obtain the advantage of a gentle untwisting of the yarn end 11.

A clamp 23 at the yarn splicing chamber 22 presses upon the yarn 10 at a clamping point K. This ensures that the yarn end 11 is inserted no further than intended into the small pipe 1 by the stream of fluid coming out of the nozzle 30.

Figure 7:
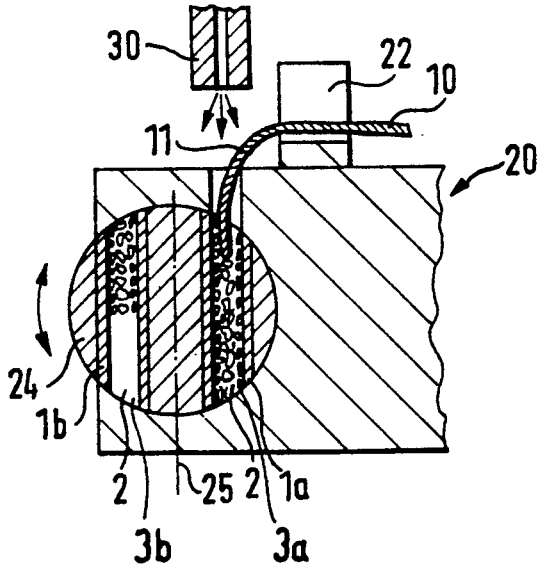

FIG. 7 shows an embodiment in which two small pipes 1*a* and 1*b* are placed on a rotatable part 24. The rotatable part 24 can be brought into two different working positions in which either the small pipe 1*a* or the small pipe 1*b* can receive the yarn end 11. The nozzle 30 is placed in the axial continuation of the small pipe 1*a* so that the yarn end 11 is blown by the stream of fluid of nozzle 30 into the small pipe 1*a*. The inner surface 2 of the small pipe 1*a* is completely structured while the structure of the inner surface 2 of the small pipe 1*b* is limited axially. Rotation of the rotatable part 24 around a rotational axis 25 in the direction of the arrow makes it possible to replace the small pipe 1*a* with the small pipe 1*b*. After a rotation of the rotatable part 24 by 180°, it is no longer the small pipe 1*a* but the small pipe 1*b* through which the stream of fluid flows.

The two small pipes 1*a* and 1*b* can be different with respect to the arrangement of the structure 3*a*, 3*b* as well as with respect to the thickness of the structure 3*a*, 3*b*, and can meet the requirement for the most gentle yarn end preparation of different yarns 10.

The adjustment of the rotatable part 24 can be achieved manually as well as mechanically by means of a service unit, for example.

Figure 8:
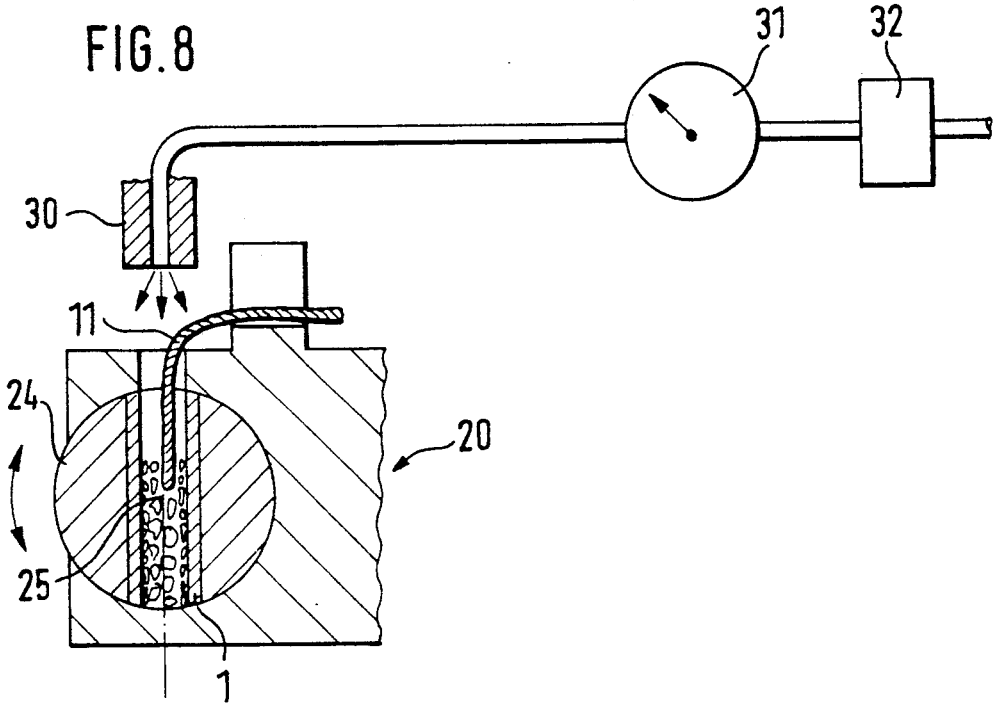

In the rotatable part 24 in the yarn splicing device 20 according to FIG. 8, only one small pipe 1 is provided. The rotational axis 25 is perpendicular to the longitudinal axis of the small pipe 1 and cuts through it in the middle. If the rotatable part is rotated by 180°, it is possible to utilize the small pipe 1 alternately by either side and to, thus, vary the length of the yarn end 11 to be untwisted in the pipe.

The nozzle 30 is preceded by a control device 31 which influences the arrival of the fluid. The arrival of the fluid coming from a pressure container 32 and going into the nozzle is stopped after each untwisting process and is readmitted again only for a new untwisting process. The control device or valve 31 limits the throughflow of fluid per yarn end preparation to a period of less than 30 ms. The fluid flow-through depends on the strength of the twist of yarn end 11. If the twist of the yarn end 11 is strong and/or uneven, i.e., if there are prominent bellies or fiber bands, or if the twist is in form of a Z as well as in form of an S, a longer period of flow-through is required in order to reverse the twist than is the case with a loose twist. If the fluid flows at intervals, i.e., if the fluid stream is constantly and briefly interrupted or weakened, the shock-like impact of the fluid on the yarn end 11 and the resulting acceleration peaks at which the yarn end 11 is thrown with great force against the sharp-edged structure on the inner surface 2 of the small pipe 1 and results in very good opening and untwisting of the yarn end 11.

Figure 9:
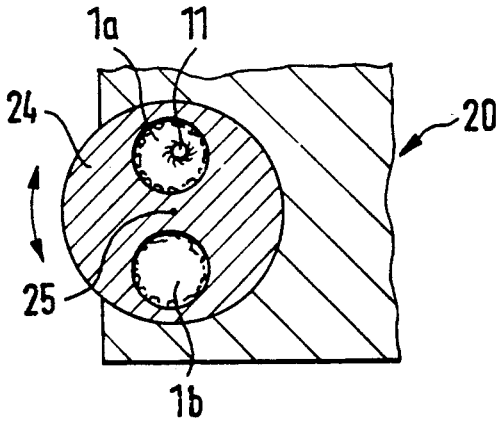
FIG. 9 shows a cross-sectional view through a yarn splicing device with two installed small pipes.

FIG. 9 shows a cross-section through a yarn splicing device 20 in which two small pipes 1*a* and 1*b* are provided in the rotatable part 24. The rotational axis 25 of the rotatable part 24 is parallel and centric with respect to the longitudinal axes of the small pipes 1*a* and 1*b*. By rotating the rotatable part 24 in the direction of the arrow it is, therefore, possible to let the fluid stream flow through the different small pipes 1*a* or 1*b* by bringing them alternately within range of the fluid stream emerging from the nozzle 30. With this design of the yarn splicing device 20 it is possible to free yarn ends of different qualities from their twist with either small pipe 1*a* or 1*b*, as best suited in each case.

In the arrangement with respect to the rotational axis 25 of the rotatable part 24 as shown in FIG. 9, it is also possible to provide small pipes for more than two yarn qualities. This can be done in the manner of a revolver magazine in which several small pipes are arranged in a circle around the rotational axis 25. The small pipe best suited for the yarn quality to be spliced at a given time is then selected by rotating the rotatable part 24 into the position in which the fluid flows through it.

The instant invention is not limited to the embodiments shown and described as examples. Thus, it is also possible to arrange a number of small pipes on a band or on a chain and to move the best-suited small pipe automatically or manually to the location of fluid flow. To do this, it is also possible to use a microprocessor which selects the best-suited small pipe, the best-suited duration of fluid flow-through, and the flow progress by means of a program as a function of the yarn quality.

We claim:

1. A device for untwisting one end portion of a single yarn in preparation for splicing in an open-end spinning device, comprising:

(a) means for presenting and retaining a portion of said yarn;

(b) at least one untwisting pipe having a longitudinal axis and an entrance and lying in a plane which is perpendicular to the longitudinal axis of the untwisting pipe disposed adjacent said yarn for receiving said one end portion of said yarn;

(c) an air nozzle means spaced axially from said end of said untwisting pipe for supplying pressurized air along said longitudinal axis of said untwisting pipe to draw said yarn end portion into said pipe;

(d) said air nozzle means having a flat exit end which is parallel to said end of said untwisting pipe;

(e) a roughened surface on at least a portion of the inner circumference of said pipe disposed for contact with said yarn end as said turbulent fluid flows through said pipe to assist in untwisting said yarn end; and (f) means to control said fluid flow through said pipe to remove substantially all twist from said end portion of said yarn.

2. A device as set forth in claim 1, wherein said roughened surface comprises an area of diagonal knurling.

3. A device as set forth in claim 1, wherein said roughened surface comprises irregularly positioned edges.

4. A device as set forth in claim 1, wherein said roughened surface has a plurality of sharp edges.

5. A device as set forth in claim 1, wherein the inner diameter of said at least one untwisting pipe is a multiple of the diameter of said yarn.

6. A device as set forth in claim 5, wherein said inner diameter does not exceed one-half of the length of said yarn end portion.

7. A device as set forth in claim 1, wherein said at least one untwisting pipe is displaceable with respect to the position of said yarn end.

8. A device as set forth in claim 1, wherein said at least one pipe is axially displaceable.

9. A device as set forth in claim 1, wherein said inner circumference of said at least one untwisting pipe is tapered outwardly at said entrance end.

10. A device as set forth in claim 1, wherein a portion of said inner circumference of said untwisting pipe is smooth.

11. A device as set forth in claim 1, wherein said entrance end of said at least one pipe has a slit extending transversely to its longitudinal axis.

12. A device as set forth in claim 1, wherein said device has a plurality of untwisting pipes.

13. A device as set forth in claim 1, wherein said device has a movable part which contains said at least one untwisting pipe.

14. A device as set forth in claim 13, wherein said movable part supports two pipes, each of which have different degrees of roughness on their inner circumferences from that of the other pipes.

15. A device as set forth in claim 13, wherein said movable part has another pipe with a zone of roughness on its inner circumference different from that in said at least one pipe.

16. The device as set forth in claim 1 further comprising said entrance end of said untwisting pipe having a conical surface.

* * * * *